US011350767B2

(12) United States Patent
Yang

(10) Patent No.: US 11,350,767 B2
(45) Date of Patent: Jun. 7, 2022

(54) PLAYPEN FRAME FOR EASY-TO-INSTALL ENCLOSURE

(71) Applicant: ZHONGTONG (XIAMEN) CHILDREN PRODUCTS CO., LTD., Xiamen (CN)

(72) Inventor: Jianbo Yang, Xiamen (CN)

(73) Assignee: ZHONGTONG (XIAMEN) CHILDREN PRODUCTS CO., LTD., Xiamen (CN)

( * ) Notice: Subject to any disclaimer, the term of this patent is extended or adjusted under 35 U.S.C. 154(b) by 0 days.

(21) Appl. No.: 16/997,952

(22) Filed: Aug. 20, 2020

(65) Prior Publication Data

US 2021/0153666 A1 May 27, 2021

(30) Foreign Application Priority Data

Nov. 26, 2019 (CN) ..... 201922062405.9

(51) Int. Cl.
*A47D 13/06* (2006.01)

(52) U.S. Cl.
CPC ..... *A47D 13/066* (2013.01)

(58) Field of Classification Search
CPC .... A47D 13/06; A47D 13/061; A47D 13/063; A47D 13/065; A47D 13/066; A47D 13/068; A61G 2203/723
See application file for complete search history.

(56) References Cited

U.S. PATENT DOCUMENTS 6,954,949 B1 * 10/2005 Chen ..... A47D 13/063 5/98.1
8,267,262 B2 * 9/2012 Thelwell ..... A47B 95/043 5/663
10,548,407 B2 * 2/2020 Polevoy ..... A47C 19/025
2004/0234333 A1 * 11/2004 Hinojosa ..... E01F 15/0469 404/6
2006/0185082 A1 * 8/2006 Casati Troutman ..... A47D 13/063 5/99.1
2008/0196163 A1 * 8/2008 Thorne ..... A47D 13/063 5/99.1
2011/0140061 A1 * 6/2011 Cheng ..... A47D 13/061 256/25
2011/0219540 A1 * 9/2011 Polevoy ..... A47C 19/021 5/200.1

(Continued)

*Primary Examiner* — David R Hare
*Assistant Examiner* — George Sun
(74) *Attorney, Agent, or Firm* — Bayramoglu Law Offices LLC

(57) ABSTRACT

A playpen frame for an easy-to-install enclosure includes four support assemblies, two long handrail tubes, two short handrail tubes and a bottom frame. The four support assemblies are distributed at four corners, and each of the support assemblies includes a support base, a support post, a slat and a pivoting piece. A height of the support post is identical to a height of the slat. The slat is located outside the support post, and a gap is arranged between the support post and the slat. The support post and the slat are arranged between the support base and the pivoting piece. The two long handrail tubes are arranged opposite to each other, and the two short handrail tubes are arranged opposite to each other. The long handrail tube or the short handrail tube is arranged between two adjacent pivoting pieces of the four support assemblies.

1 Claim, 6 Drawing Sheets

(56) References Cited

U.S. PATENT DOCUMENTS

| | | | | |
|---|---|---|---|---|
| 2011/0284813 | A1* | 11/2011 | Zhang | A47D 13/063<br>256/25 |
| 2012/0012801 | A1* | 1/2012 | Burns | A47D 13/06<br>256/25 |
| 2012/0216346 | A1* | 8/2012 | Rampton | A47D 13/061<br>256/25 |
| 2013/0240815 | A1* | 9/2013 | Wiegmann | A47D 13/063<br>256/25 |
| 2015/0001455 | A1* | 1/2015 | Chen | A47D 13/066<br>256/65.01 |
| 2015/0047123 | A1* | 2/2015 | Polevoy | A47C 19/021<br>5/286 |
| 2018/0192786 | A1* | 7/2018 | Horst | A47D 11/007 |
| 2019/0335919 | A1* | 11/2019 | Pacella | A47D 13/063 |
| 2020/0146465 | A1* | 5/2020 | Thorne | A47D 13/063 |

* cited by examiner

PLAYPEN FRAME FOR EASY-TO-INSTALL ENCLOSURE

CROSS REFERENCE TO THE RELATED APPLICATIONS

This application is based upon and claims priority to Chinese Patent Application No. 201922062405.9, filed on Nov. 26, 2019, the entire contents of which are incorporated herein by reference.

TECHNICAL FIELD

The present invention relates to children's products, and more particularly, to a playpen frame for an easy-to-install enclosure.

BACKGROUND

The playpen is mainly composed of a frame body and an enclosure. The enclosure provides a safe space for a child to play, which can prevent the child from climbing out and falling. The playpen frame in the prior art includes four support assemblies, two long handrail tubes, two short handrail tubes and a bottom frame. The four support assemblies are distributed at four corners, and each of the support assemblies includes a support base, a circular post and a pivoting piece. The circular post is connected between the support base and the pivoting piece. The long handrail tube or the short handrail tube is arranged between adjacent pivoting pieces. The bottom frame is connected to the support bases of the four support assemblies. First tube holes are provided along the periphery of the top surface of the enclosure of the playpen in the prior art, and second tube holes are provided at the four corners of the enclosure. The first tube holes are used for inserting the long handrail tubes or the short handrail tubes, and the second tube holes are used for inserting the circular posts. During the installation of the enclosure, the circular posts are inserted into the corresponding second tube holes, and the long handrail tubes or the short handrail tubes are inserted into the corresponding first tube holes. Next, the circular posts are connected between the support bases and the pivoting pieces, and the long handrail tubes and the short handrail tubes are connected between the corresponding adjacent two pivoting pieces. One can see, therefore, that during manufacture and assembly of the prior art enclosure of the playpen, it is necessary to thread the four second tube holes through the circular posts. Therefore, the manufacturing procedure of the enclosure is cumbersome and the assembly of the enclosure is time-consuming.

SUMMARY

In order to solve the above problems in the prior art, the present invention provides a playpen frame for an easy-to-install enclosure.

The present invention is implemented by the following technical solution.

A playpen frame for an easy-to-install enclosure includes four support assemblies, two long handrail tubes, two short handrail tubes and a bottom frame. The four support assemblies are distributed at four corners, and each of the support assemblies includes a support base, a support post, a slat and a pivoting piece. A height of the support post is identical to a height of the slat. The slat is located outside the support post, and a gap is arranged between the support post and the slat. The support post and the slat are arranged between the support base and the pivoting piece. The two long handrail tubes are arranged opposite to each other, and the two short handrail tubes are arranged opposite to each other. The long handrail tube or the short handrail tube is arranged between two adjacent pivoting pieces of the four support assemblies. The bottom frame is connected to the support bases of the four support assemblies.

Further, a lateral cross section of the support post has an oval shape in a top view. The slat is a circular arc slat with a radian adapted to the outer half periphery of the support post. The inner peripheral surface of the slat extends inwards along a height direction to form a plurality of convex ribs. The top surface of the support base is provided with a first slot adapted to the bottom of the support post and a second slot adapted to the bottom of the slat. A third slot adapted to the top of the support post and a fourth slot adapted to the top of the slat are provided in the middle of the pivoting piece. The bottom and the top of the support post are inserted into the first slot and the third slot, respectively. The bottom and the top of the slat are inserted into the second slot and the fourth slot, respectively.

Further, a containing slot is provided inside the support base.

From the above description, compared with the prior art, the present invention has the advantages of a novel structure and clever design. No second tube hole is required to be provided at the four corners of the enclosure matched with the present invention, but a hook and a loop of a hook-and-loop fastener are sewn on two side ends of the enclosure, respectively. When the long handrail tubes and the short handrail tubes are inserted into the first tube holes corresponding to the enclosure and are then fixed, one side end of the enclosure is sequentially passed through gaps between the support posts and the slats of the four support assemblies. Finally, the two side ends of the enclosure are connected through the hook-and-loop fastener to complete the installation of the enclosure. The present invention simplifies the manufacturing procedure of the enclosure and allows for easy assembly and disassembly of the enclosure.

DETAILED DESCRIPTION OF THE EMBODIMENTS

Figure 1:
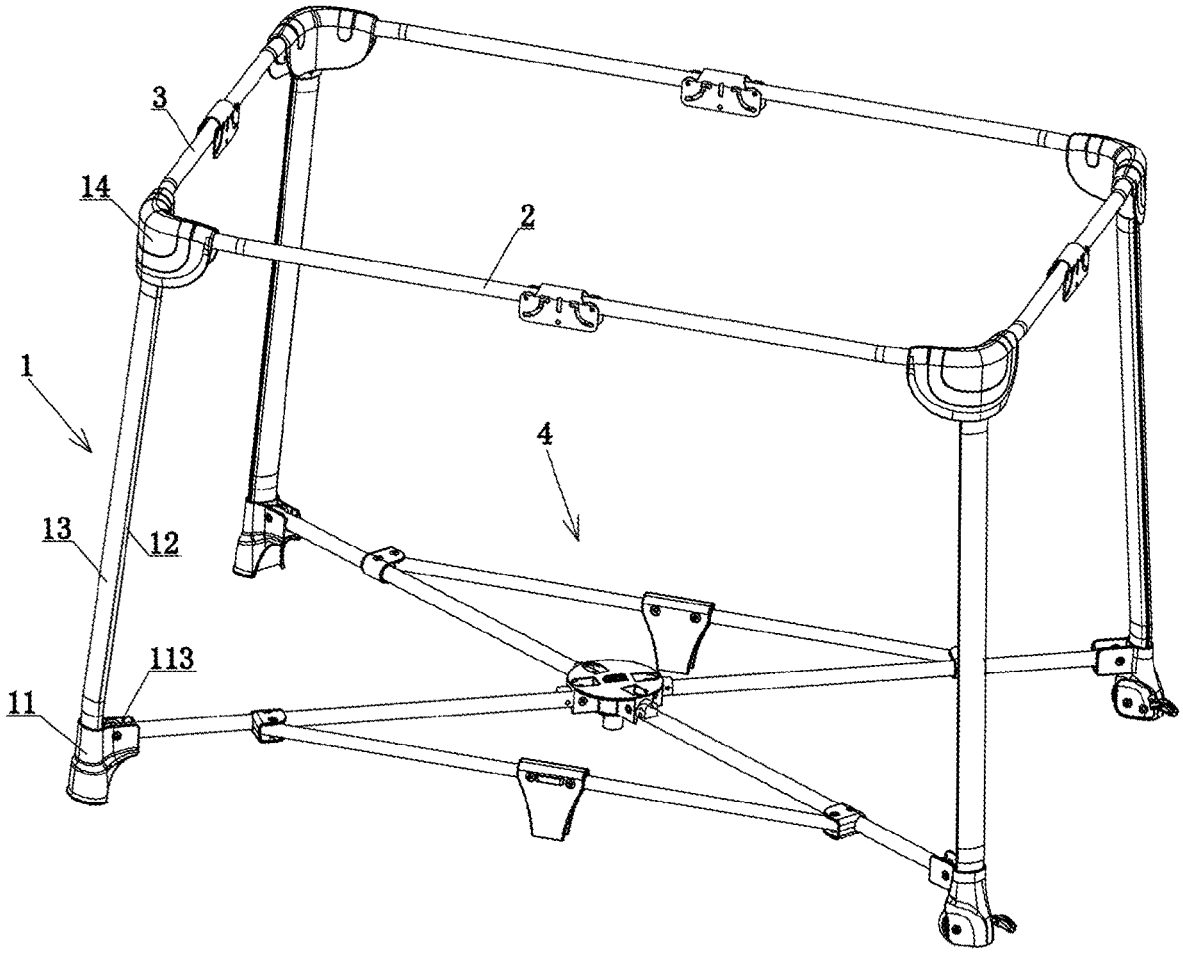
FIG. 1 is a schematic diagram showing the structure of the present invention.
Figure 2:
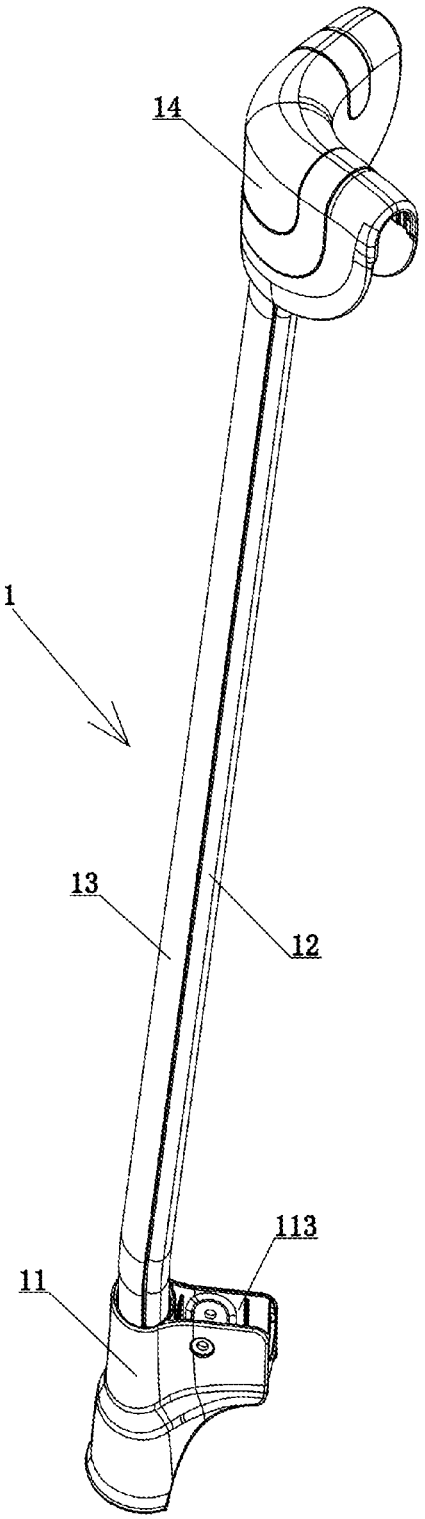
FIG. 2 is a schematic diagram showing the structure of a support assembly of the present invention.
Figure 3:
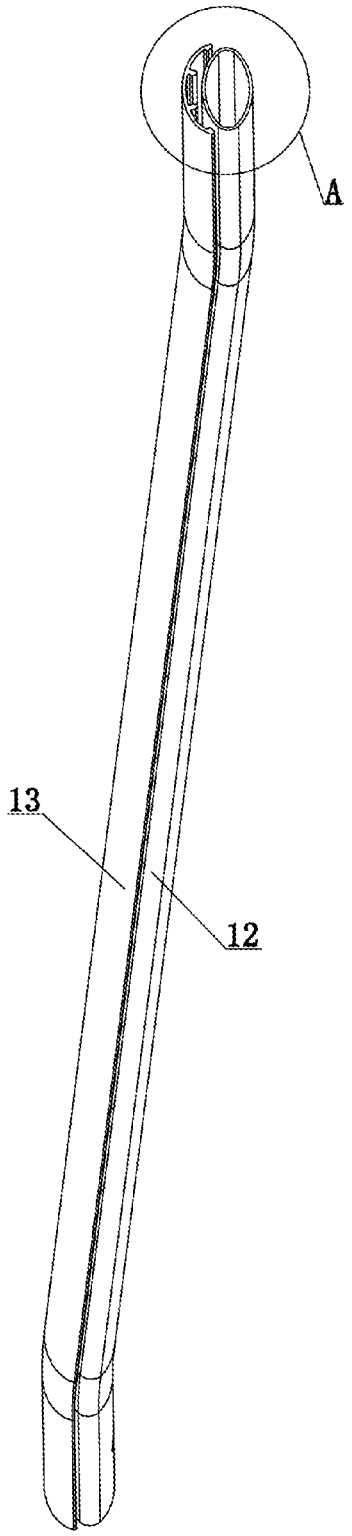
FIG. 3 is a schematic diagram showing the structure of a support post and a slat of the present invention.
Figure 4:
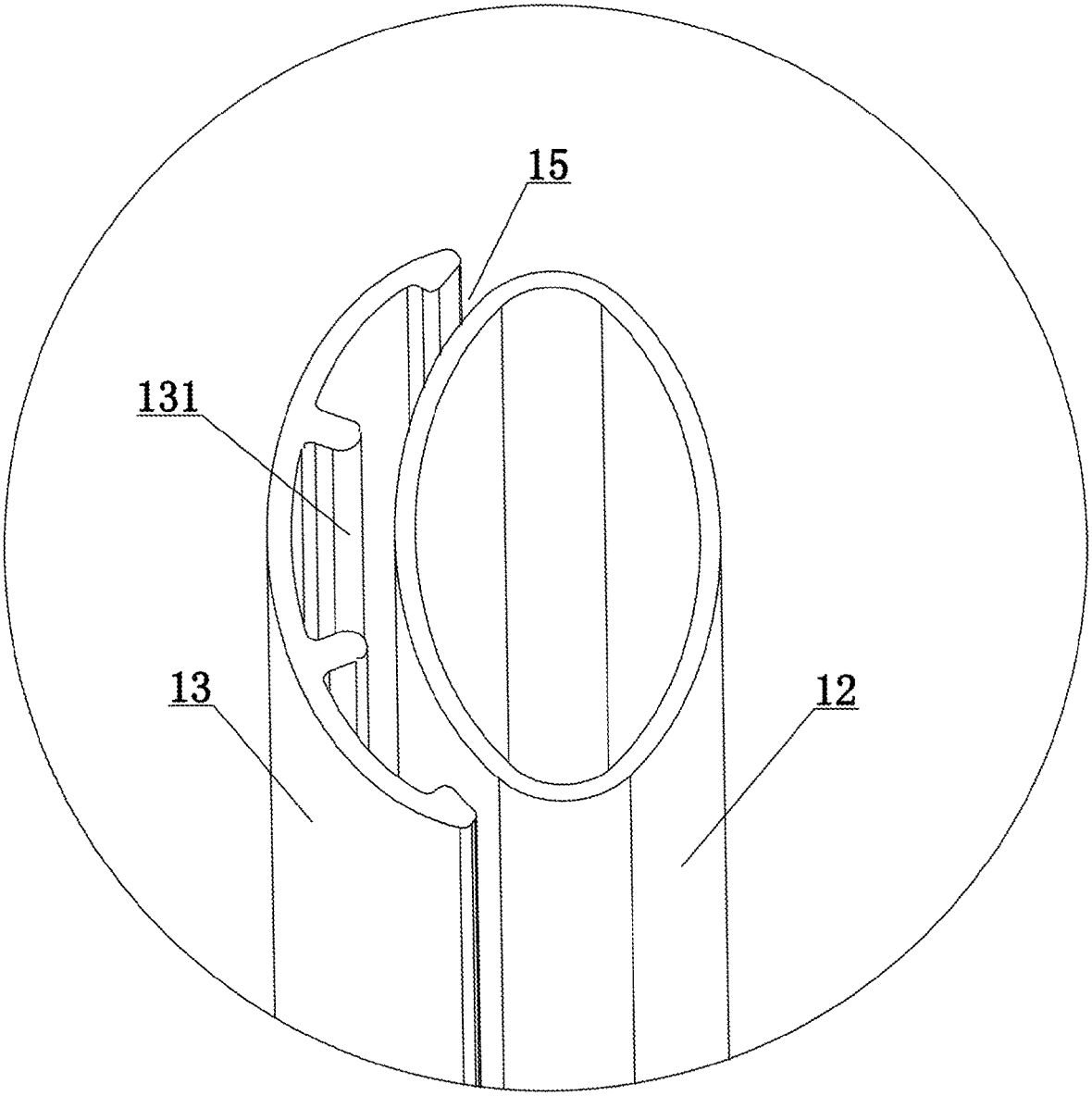
FIG. 4 is a partially enlarged view of A in FIG. 3.
Figure 5:
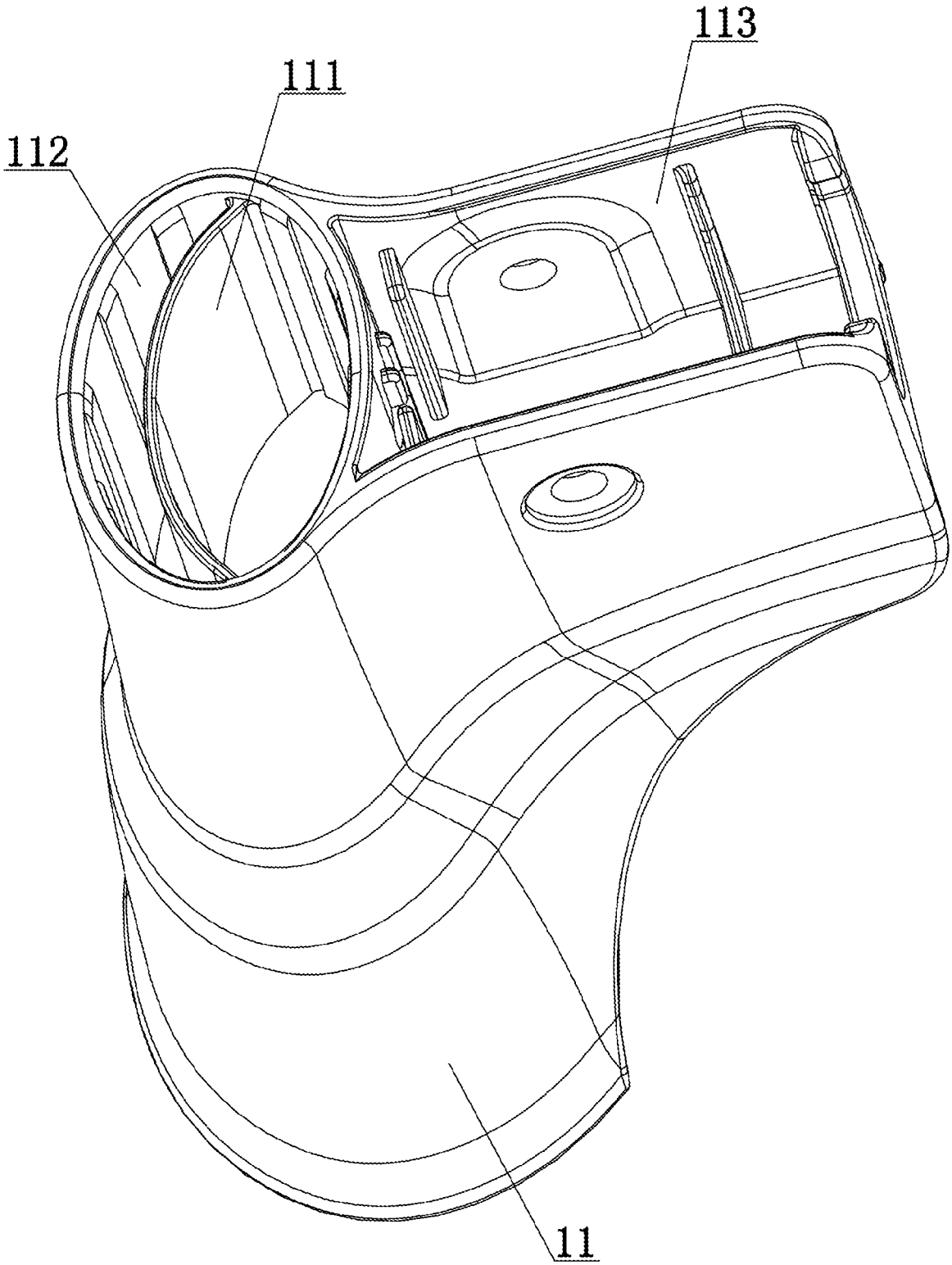
FIG. 5 is a schematic diagram showing the structure of a support base of the present invention.
Figure 6:
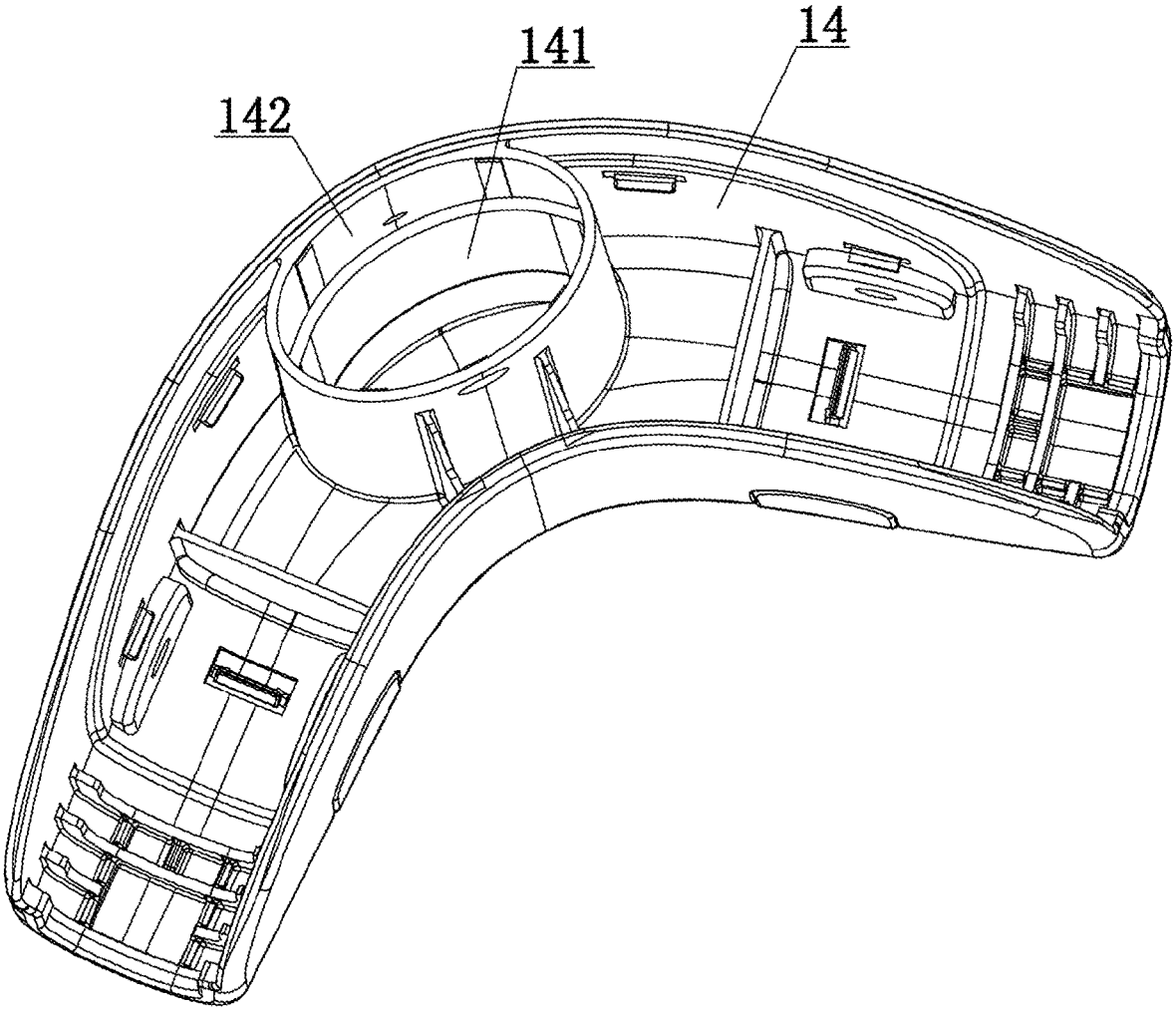
FIG. 6 is a schematic diagram showing the structure of a pivoting piece of the present invention.

Referring to FIGS. 1 to 4, a playpen frame for an easy-to-install enclosure includes four support assemblies 1, two long handrail tubes 2, two short handrail tubes 3 and a bottom frame 4. The four support assemblies 1 are distributed at four corners, and each of the support assemblies 1 includes the support base 11, the support post 12, the slat 13 and the pivoting piece 14. The height of the support post 12 is identical to the height the slat 13. The slat 13 is located outside the support post 12, and the gap 15 is arranged between the support post 12 and the slat 13. The support post 12 and the slat 13 are arranged between the support base 11 and the pivoting piece 14. The two long handrail tubes 2 are arranged opposite to each other, and the two short handrail tubes 3 are also arranged opposite to each other. The long handrail tube 2 or the short handrail tube 3 is arranged between two adjacent pivoting pieces 14 of the four support assemblies 1. The bottom frame 4 is connected to the support bases 11 of the four support assemblies 1.

Referring to FIGS. 1 to 6, the lateral cross section of the support post 12 is in an oval shape in a top view. The slat 13 is a circular arc slat with a radian adapted to the outer half periphery of the support post 12. The inner peripheral surface of the slat 13 extends inwards along a height direction to form a plurality of convex ribs 131, and the plurality of convex ribs 131 can support the enclosure. The top surface of the support base 11 is provided with the first slot 111 adapted to the bottom of the support post 12 and the second slot 112 adapted to the bottom of the slat 13. The third slot 141 adapted to the top of the support post 12 and the fourth slot 142 adapted to the top of the slat 13 are provided in the middle of the pivoting piece 14. The bottom and the top of the support post 12 are inserted into the first slot 111 and the third slot 141, respectively. The bottom and the top of the slat 13 are inserted into the second slot 112 and the fourth slot 142, respectively. The containing slot 113 is provided inside the support base 11, and the four corners of the bottom frame 4 are connected into the corresponding containing slots 113, respectively.

Referring to FIG. 1, the two long handrail tubes 2 and the two short handrail tubes 3 are connected to the corresponding pivoting pieces 14 by known means, and the bottom frame 4 adopts a structure that is known by skilled artisans, which will not be repeated here.

Referring to FIGS. 1 to 4, the design principle of the present invention is as follows: no second tube hole is required at the four corners of the enclosure matched with the present invention, but a hook and a loop of a hook-and-loop fastener are sewn on two side ends of the enclosure, respectively. When the long handrail tubes 2 and the short handrail tubes 3 are inserted into the first tube holes corresponding to the enclosure and are then fixed, one side end of the enclosure is sequentially passed through gaps between the support posts 12 and the slats 13 of the four support assemblies 1. Finally, the two side ends of the enclosure are connected through the hook-and-loop fastener to complete the installation of the enclosure.

The above described are merely specific implementations of the present invention, but the design concept of the present invention is not limited thereto. Any non-substantial changes made to the present invention based on the concept of the present invention shall fall within the scope of protection of the present invention.

What is claimed is:

1. A playpen frame for an easy-to-install enclosure, comprising four support assemblies, two long handrail tubes, two short handrail tubes and a bottom frame; wherein the four support assemblies are distributed at four corners of the bottom frame, and each support assembly of the four support assemblies comprises a support base, a support post, a slat and a pivoting piece; a height of the support post is identical to a height of the slat; the slat is located outside the support post, and a gap is arranged between the support post and the slat; the support post and the slat are arranged between the support base and the pivoting piece; the two long handrail tubes are arranged opposite to each other, and the two short handrail tubes are arranged opposite to each other; each long handrail tube of the two long handrail tubes is arranged between a two adjacent pivoting pieces of the four support assemblies, or each short handrail tube of the two short handrail tubes is arranged between the two adjacent pivoting pieces of the four support assemblies; each of the four corners of the bottom frame is connected to the support base of the each support assembly, wherein, a containing slot is provided inside the support base of the each support assembly—such that each of the four corners of the bottom frame is inserted into the containing slot of the support base of the each support assembly;

wherein, a lateral cross section of the support post is in an oval shape in a top view; the slat is a circular arc slat, and the circular arc slat has a radian adapted to an outer half periphery of the support post; an inner peripheral surface of the slat extends inwards along a height direction to form a plurality of convex ribs; a top surface of the support base is provided with a first slot adapted to a bottom of the support post and a second slot adapted to a bottom of the slat; a third slot adapted to a top of the support post and a fourth slot adapted to a top of the slat are provided in a middle of the pivoting piece; the bottom of the support post is inserted into the first slot, and the top of the support post is inserted into the third slot; the bottom of the slat is inserted into the second slot, and the top of the slat is inserted into the fourth slot.

* * * * *